US008141529B2

(12) United States Patent
Ikeda

(10) Patent No.: US 8,141,529 B2
(45) Date of Patent: Mar. 27, 2012

(54) VALVE TIMING CONTROL APPARATUS

(75) Inventor: Kenji Ikeda, Anjo (JP)

(73) Assignee: Aisin Seiki Kabushiki Kaisha, Kariya-Shi, Aichi (JP)

( * ) Notice: Subject to any disclaimer, the term of this patent is extended or adjusted under 35 U.S.C. 154(b) by 0 days.

(21) Appl. No.: 13/141,635

(22) PCT Filed: Feb. 16, 2010

(86) PCT No.: PCT/JP2010/052272

§ 371 (c)(1),
(2), (4) Date: Jun. 22, 2011

(87) PCT Pub. No.: WO2010/122831

PCT Pub. Date: Oct. 28, 2010

(65) Prior Publication Data

US 2011/0253087 A1 Oct. 20, 2011

(30) Foreign Application Priority Data

Apr. 22, 2009 (JP) ..... 2009-104406

(51) Int. Cl.
*F01L 1/34* (2006.01)

(52) U.S. Cl. ..... 123/90.17; 123/90.15; 464/160

(58) Field of Classification Search ..... 123/90.15, 123/90.16, 90.17, 90.18; 464/160, 1, 2
See application file for complete search history.

(56) References Cited

U.S. PATENT DOCUMENTS 6,053,139 A 4/2000 Eguchi et al.
6,497,208 B2 * 12/2002 Miyasaka ..... 123/90.17
6,779,499 B2 8/2004 Takenaka et al.
7,363,898 B2 4/2008 Suzuki et al.
2002/0134334 A1 9/2002 Yamada et al.
(Continued)

FOREIGN PATENT DOCUMENTS

JP 11-311107 A 11/1999
(Continued)

OTHER PUBLICATIONS

* International Search Report (PCT/ISA/210) issued on Mar. 23, 2010, by Japanese Patent Office as the International Searching Authority for International Application No. PCT/JP2010/052272.

(Continued)

*Primary Examiner* — Ching Chang
(74) *Attorney, Agent, or Firm* — Buchanan Ingersoll & Rooney PC

(57) ABSTRACT

A valve timing control apparatus includes a locking mechanism having a locking member disposed in an accommodating portion formed in one of a drive-side rotor and a driven-side rotor and projectable into and retractable from the other rotor than the one rotor having the accommodating portion and a locking groove defined in the other rotor for receiving and retaining the locking member projecting therein, the locking mechanism for restraining a relative rotational phase when the locking member is retained within the locking groove. The apparatus further includes a restricting mechanism having a restricting member disposed within the accommodating portion and projectable into and retractable from the other rotor to be movable relative to and together with the locking member in a projecting/retracting direction of the locking member and a restricting groove defined in the form of an elongate slot in the other rotor for receiving the restricting member projecting therein, the restricting mechanism restricting the relative rotational phase within a predetermined range when the restricting member projects into the restricting groove.

9 Claims, 7 Drawing Sheets

U.S. PATENT DOCUMENTS

| | | | |
|---|---|---|---|
| 2002/0139332 | A1 | 10/2002 | Takenaka |
| 2005/0284432 | A1 | 12/2005 | Tsukada |

FOREIGN PATENT DOCUMENTS

| | | | |
|---|---|---|---|
| JP | 2002-357105 | A | 12/2002 |
| JP | 2003-214123 | A | 7/2003 |
| JP | 2006-009673 | A | 1/2006 |
| JP | 2007-132272 | A | 5/2007 |
| JP | 2007-198365 | A | 8/2007 |

OTHER PUBLICATIONS

* Written Opinion (PCT/ISA/237) issued on Mar. 23, 2010 by Japanese Patent Office as the International Searching Authority for International Application No. PCT/JP2010/052272.

Extended European Search Report issued by the European Patent Office on Dec. 28, 2011 in European Application No. 10 76 6891.

* cited by examiner

【Fig.1】
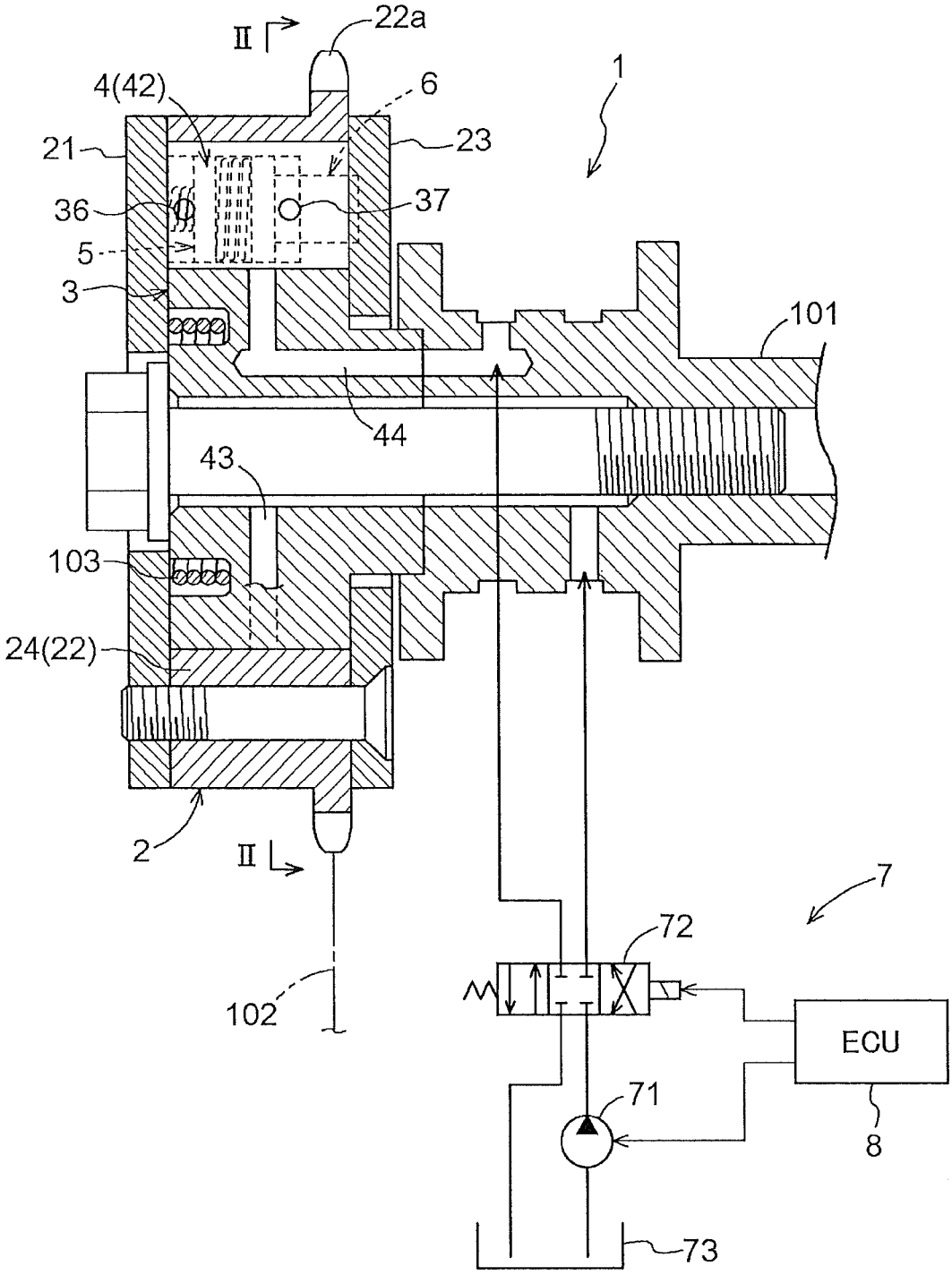

【Fig.2】
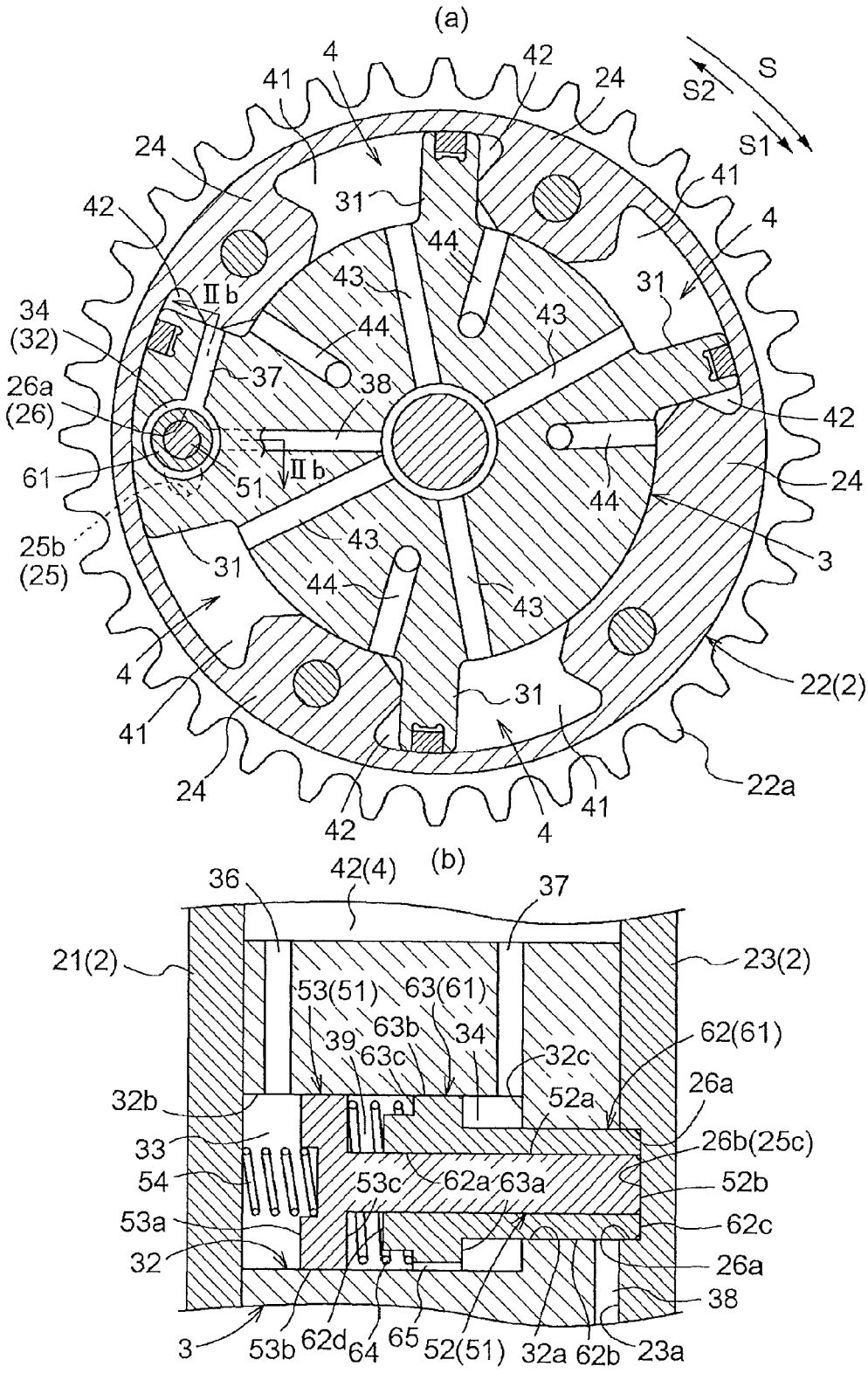

【Fig.3】
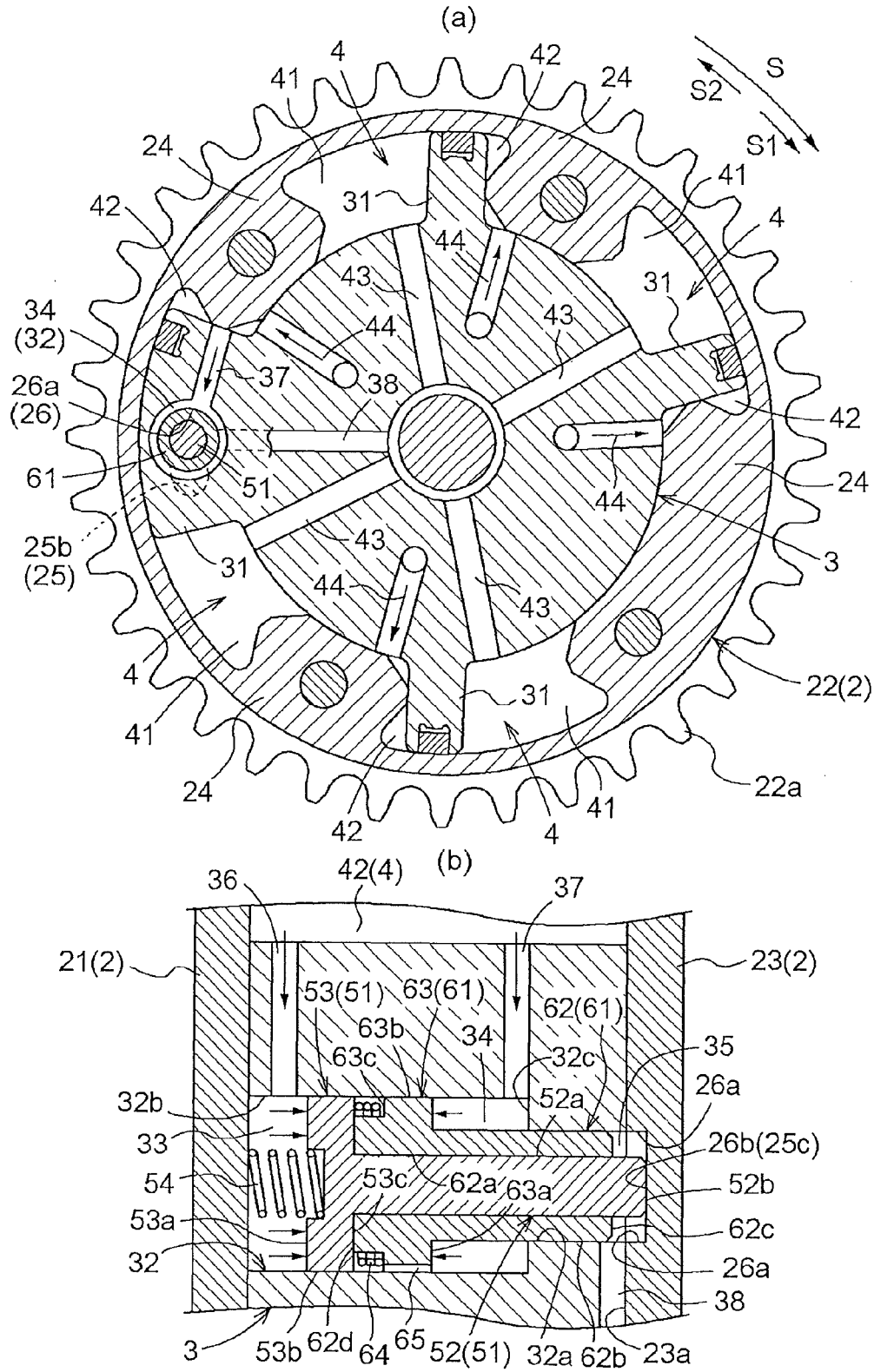

【Fig.4】
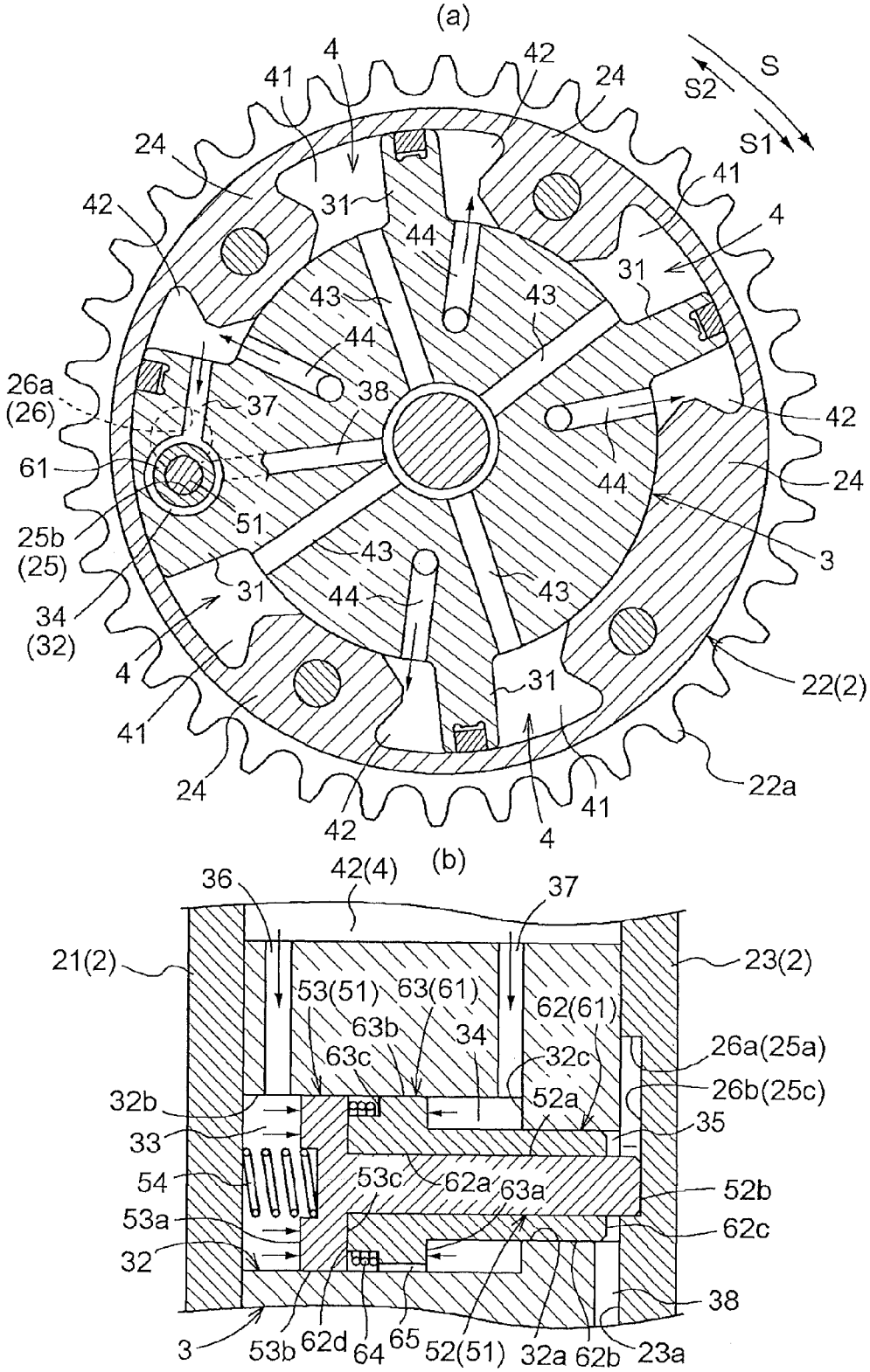

【Fig.5】
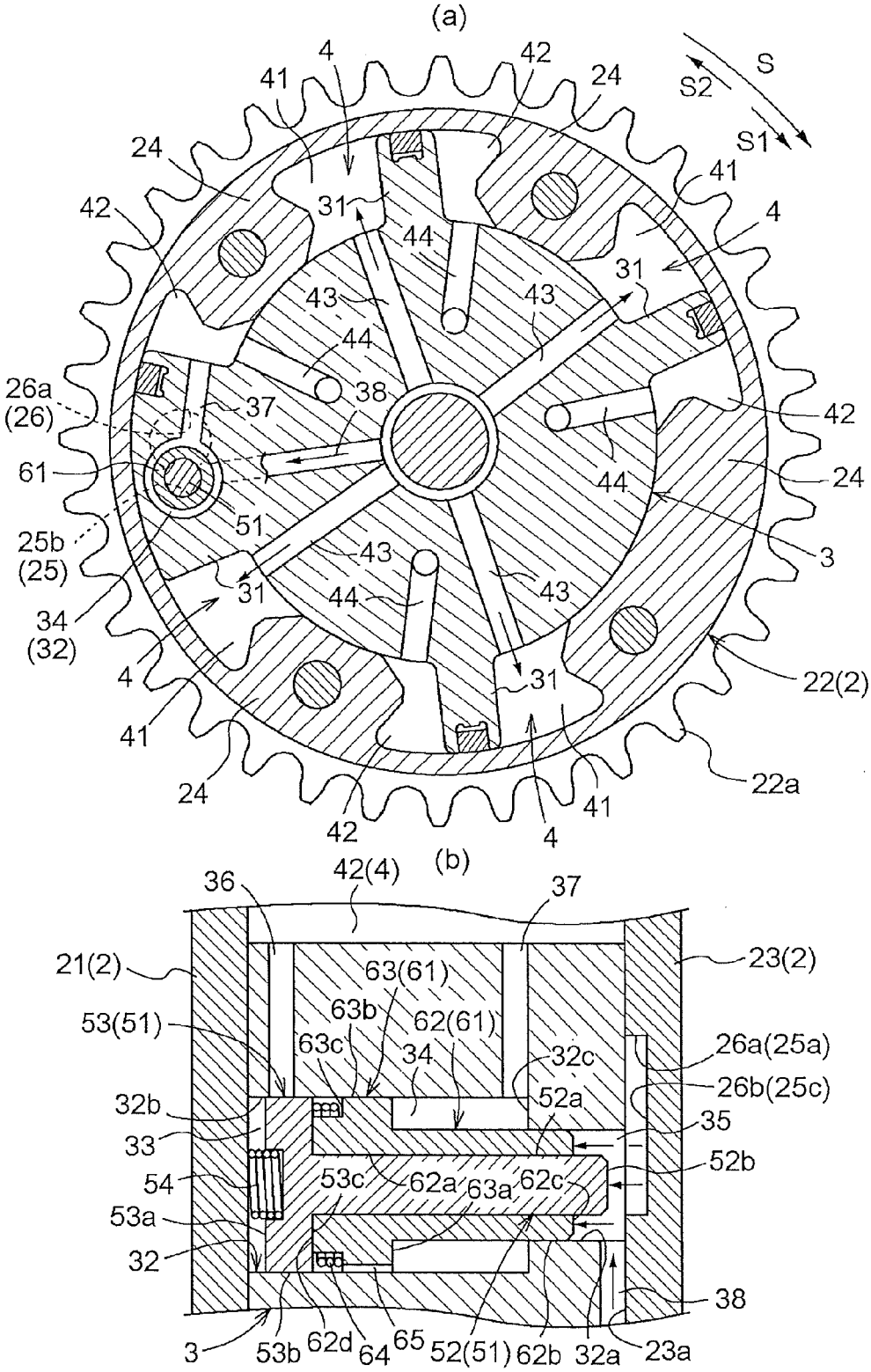

【Fig.6】
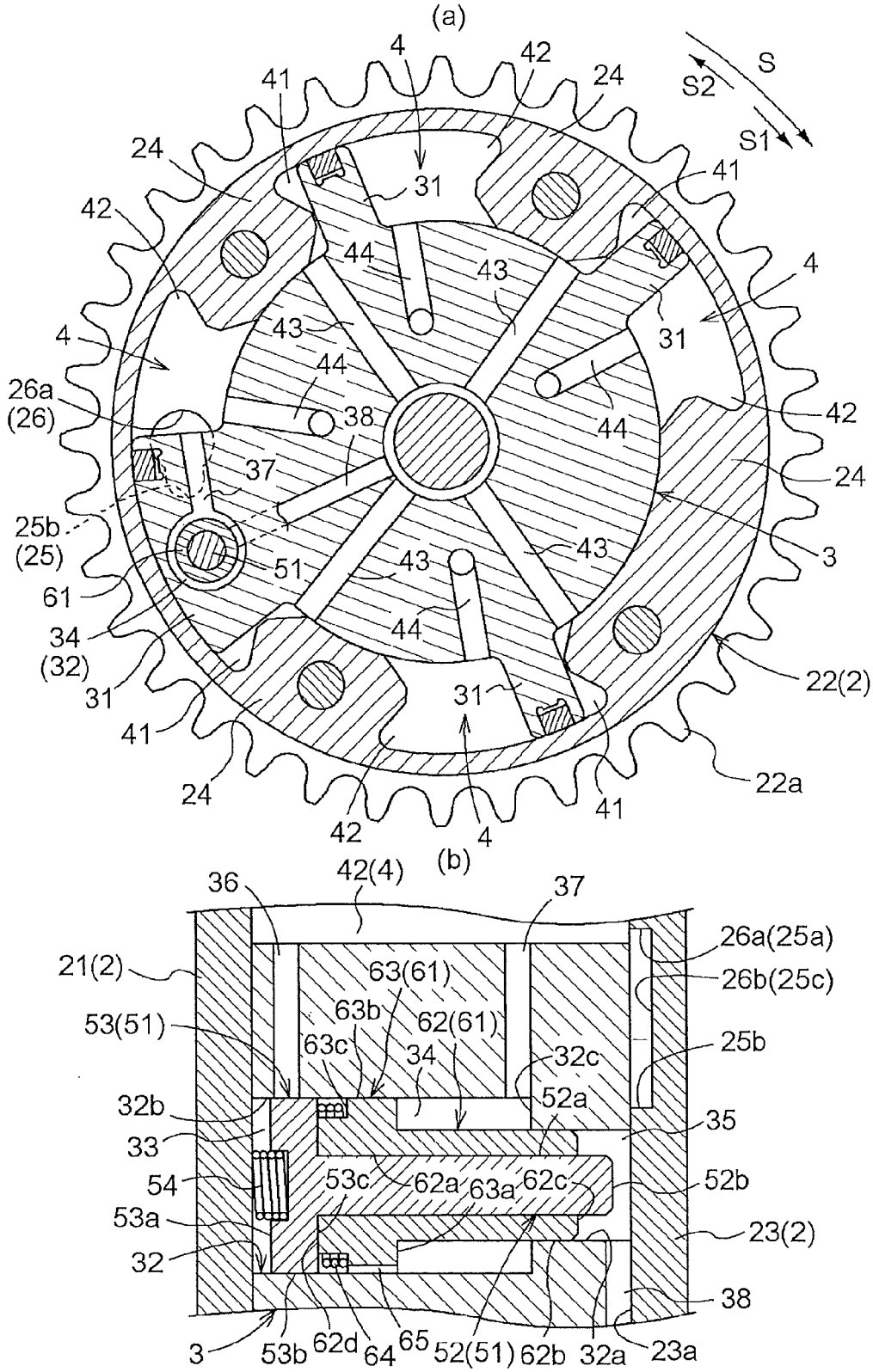

【Fig.7】
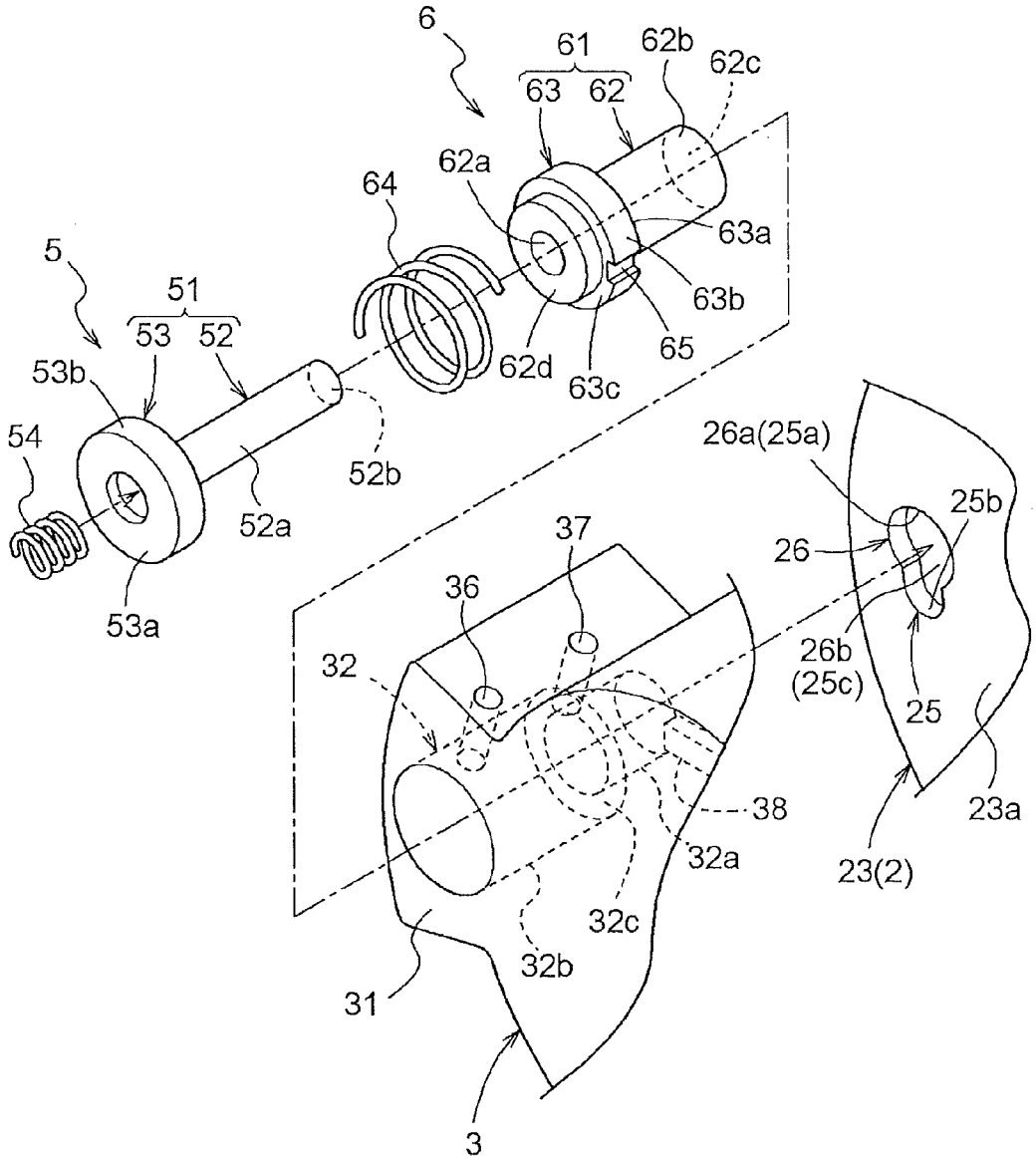

VALVE TIMING CONTROL APPARATUS

TECHNICAL FIELD

The present invention relates to a valve timing control apparatus for controlling a relative rotational phase of a driven-side rotor relative to a drive-side rotor which is rotatable in synchronism with a crankshaft of an internal combustion engine.

BACKGROUND ART

Conventionally, as disclosed in Patent Document 1 identified below, there was known a valve timing control apparatus including a locking mechanism for restraining a relative rotational phase of a driven-side rotor relative to a drive-side rotor and a restricting mechanism provided at a different position along the direction of relative rotation than the locking mechanism and configured for restricting a relative rotational movement within a predetermined range. The locking mechanism includes a locking member provided in the drive-side rotor and a locking groove defined in the driven-side rotor for receiving and retaining the locking member projecting therein. Further, the restricting mechanism includes a restricting member disposed in the drive-side rotor and a restricting groove defined as an elongate slot in the driven-side rotor for receiving the restricting member projecting therein.

With the above-described technique, only with execution of a controlling operation to the angle advancing side or angle retarding side, the restraint of the relative rotational phase by the locking mechanism can be released and then the relative rotational phase can be restricted within the predetermined range by means of the restricting mechanism. That is, after appropriate start-up of the internal combustion engine in the phase restrained by the locking mechanism, even in a situation when precision phase control is difficult due to the work fluid being at a low temperature, the relative rotational phase can be restricted to a predetermined phase by means of the restricting mechanism.

Patent Document 2 identified also below discloses a valve timing control apparatus including an angle advancement restricting mechanism for restricting displacement of the relative rotational phase to the angle advancing side from a predetermined phase between the most advanced angle phase and the most retarded angle phase, an angle retardation restricting mechanism for restricting displacement of the relative rotational phase from the predetermined phase to the angle retarding side, and hydraulic control valves provided exclusively for controlling the work fluid to act on these mechanisms respectively. The angle advancement restricting mechanism and the angle retardation restricting mechanism each includes a restricting member and a restricting groove into which the restricting member can project. Further, the restricting groove of the angle advancement restricting mechanism has an increased depth at its position corresponding to the predetermined phase, so that when the restricting member enters this increased depth portion, the relative rotational phase can be restrained to the predetermined phase.

With the above-described technique, through controlling of the hydraulic control valves, the relative rotational phase can be restrained to the predetermined phases in a reliable manner at the time of stopping of the internal combustion engine or at the time of next start-up thereof.

PRIOR ART DOCUMENTS

Patent Documents

Patent Document 1: Japanese Unexamined Patent Application Publication No. 2007-198365

Patent Document 2: Japanese Unexamined Patent Application Publication No. 2002-357105

SUMMARY OF THE INVENTION

Object to be Achieved by Invention

However, with the technique of Patent Document 1, since the locking mechanism and the restricting mechanism are provided at different positions, the technique tends to invite increase in the complexity of the construction, increase in the number of components and increase in the manufacture cost. Further, since the locking mechanism and the restricting mechanism are both provided along the direction of relative rotation, the space available in the relative rotation direction for the formation of the advanced angle chamber and the retarded angle chamber is limited, thus making it impossible to increase the possible angle for relative rotation.

On the other hand, with the technique of Patent Document 2, the angle advancement restricting mechanism and the angle retardation restricting mechanism are provided in close vicinity with each other. However, since the restricting member of the angle advancement restricting mechanism acts both as a component for restraining the relative rotational phase and as a component for restricting it within a predetermined range, upon release of the restraint, this releases the restriction also. Therefore, it is not possible to effect such controlling operation for restricting the relative rotational phase to a predetermined phase after appropriate start-up of the internal combustion engine in a restrained phase.

In view of the above-described state of the art, the object of the present invention is to provide a valve timing control apparatus capable of reliably restraining or restricting a relative rotational phase of a driven-side rotor relative to a drive-side rotor to a predetermined phase between the most advanced angle phase and the most retarded angle phase, with a simple arrangement and with a small number of components.

Means for Achieving the Object

For achieving the above-noted object, according to the first characterizing feature of a valve timing control apparatus relating to the present invention, there is provided a valve timing control apparatus comprising:

- a drive-side rotor rotatable in synchronism with a crankshaft of an internal combustion engine;
- a driven-side rotor disposed coaxially relative to the drive-side rotor and rotatable in synchronism with a valve opening/closing cam shaft of the internal combustion engine;
- a fluid pressure chamber formed by said drive-side rotor and said drive-side rotor;
- a partitioning portion provided in at least one of said drive-side rotor and said driven-side rotor for partitioning said fluid pressure chamber into an advanced angle chamber and a retarded angle chamber;
- a locking mechanism including;
  - a locking member disposed within an accommodating portion formed in one of said drive-side rotor and said driven-side rotor and projectable to and retractable from the other rotor than the one rotor having said accommodating portion; and
  - a locking groove defined in said other rotor for receiving and retaining said locking member projected therein;

said locking mechanism restraining a relative rotational phase of said driven-side rotor relative to said drive-side rotor when said locking member is retained within said locking groove; and a restricting mechanism including;

a restricting member disposed within said accommodating portion and projectable to and retractable from said other rotor so as to be movable relative to and together with said locking member in a projecting/retracting direction of said locking member, and a restricting groove defined in the form of an elongate slot in said other rotor so as to receive said restricting member projected therein, said restricting mechanism restricting said relative rotational phase within a predetermined range when said restricting member projects into said restricting groove.

With the above-described arrangement, the locking member and the restricting member are both accommodated within the accommodating portion and the locking member and the restricting member are movable relative to and together with each other. With this, individual behavior of the locking mechanism and the restricting mechanism are maintained. In addition, compared with the arrangement of the locking mechanism and the restricting mechanism being provided at different positions, the above inventive arrangement allows for simplicity of the construction, the reduction of the number of components, reduction of the manufacture cost, etc. Moreover, as the space required for layout can be reduced, the arrangement hardly affects the relative rotational angle between the drive-side rotor and the driven-side rotor.

According to the second characterizing feature of the valve timing control apparatus relating to the present invention, said locking mechanism is configured to restrain the relative rotational phase to the most advanced angle phase, the most retarded angle phase or a predetermined phase between the most advanced angle phase and the most retarded angle phase, and said restricting mechanism is configured to restrict the relative rotational phase within a range from either the most advanced angle phase or the most retarded angle phase to said predetermined phase.

With the above-described arrangement, the locking mechanism can restrain the relative rotational phase to the most advanced angle phase, the most retarded angle phase or the predetermined phase, and the restricting mechanism can restrict the relative rotational phase within a range from either the most advanced angle phase or the most retarded angle phase to the predetermined phase. Therefore, the valve timing control apparatus can be configured as a highly useful apparatus capable of effecting such controls as a control for restricting the relative rotational phase within a predetermined range by the restricting mechanism thereby to ensure the restraint of the relative rotational phase to a predetermined phase by the locking mechanism, a control for effecting the restriction of the relative rotational phase to the predetermined phase by the restricting mechanism after releasing of the restraint of the relative rotational phase to the most advance angle phase or the most retarded angle phase by the locking mechanism, etc.

According to the third characterizing feature of the valve timing control apparatus relating to the present invention, the valve timing control apparatus further comprises:

a lock releasing passageway capable of applying work fluid to said locking member to retract this locking member from said locking groove;

a restriction retaining passageway capable of applying the work fluid to said restricting member only when said restricting member has projected into said restricting groove for retaining this restricting member projected into said restricting groove; and a restriction releasing passageway capable of applying the work fluid at least to said locking member of the locking member and the restricting member only when said locking member has retracted from said locking groove for retracting the restricting member from the retracting groove via the locking member.

With the above-described arrangement, when the work fluid is applied from the lock releasing passageway to the locking member, the locking member is retracted from the locking groove, whereby the restraint of the relative rotational phase by the locking mechanism is released. Also, while the restricting member is being projected into the restricting groove, if the work fluid is applied from the restriction retaining passageway to the restricting member, the restricting member can be kept under its state of being projected into the restricting groove. Namely, the restriction of the relative rotational phase can be maintained, irrespectively of the projecting/retracting movement of the locking member. Further, when the locking member has retracted from the locking groove, if the work fluid is applied from the restriction releasing passageway at least to the locking member, the restricting member will move together with the locking member to retract from the restricting groove. With this arrangement, through the simple arrangement of selective feeding of the work fluid to the lock releasing passageway, the restriction retaining passageway and the restriction releasing passageway, the locking mechanism and the restricting mechanism comprised of the locking member and the restricting member that can move relative to and together with each other can be controlled individually.

According to the fourth characterizing feature of the valve timing control apparatus relating to the present invention, said lock releasing passageway is formed in the rotor having said accommodating portion for establishing constant communication between either said advanced angle chamber or said retarded angle chamber and said accommodating portion;

said restriction retaining passageway is formed in said rotor having said accommodating portion and capable of establishing communication between said accommodating portion and the same one chamber of the advanced angle chamber and the retarded angle chamber as said chamber communicated by said lock releasing passageway;

said restriction releasing passageway is formed in either said drive-side rotor or said driven-side rotor and capable of establishing communication between said accommodating portion and the other chamber of said advanced angle chamber and said retarded angle chamber than the one chamber communicated by said lock releasing passageway; and neither said lock releasing passageway nor said restriction retaining passageway are communicated with said restriction releasing passageway via said accommodating portion.

With the above-described arrangement, the lock releasing passageway and the restriction retaining passageway establish communication between the same one of the advanced angle chamber and the retarded angle chamber and the accommodating portion, and the restriction releasing passageway establishes communication between the other one chamber of the advanced angle chamber and the retarded angle chamber than the one chamber communicated by the lock releasing passageway or the like and the accommodating portion. Therefore, under the condition when the locking member is engaged into the locking groove and the restricting member projects into the restricting groove, in response to feeding of work fluid to the advanced angle chamber or the retarded angle chamber, the locking member will retract from the locking groove and the restricting member will not retract from the restricting groove. Therefore, even after release of the restraint by the locking mechanism, the restriction of the relative rotational phase by the restricting mechanism can be continuously provided. Under this condition, if the work fluid is fed to the other chamber, the restricting member will move together with the locking member and retract from the restricting groove. After release of the restraint by the restricting mechanism, because the lock releasing passageway and the restriction releasing passageway provide constant communication between either one of the advanced angle chamber and the retarded angle chamber and the accommodating portion, as long as the work fluid is fed to either one of the advanced angle chamber and the retarded angle chamber, the restricting member and the locking member will be kept under their retracted states, respectively. So, the relative rotational phase can be freely varied. In this way, only with the selective feeding of work fluid to the advanced angle chamber and the retarded angle chamber, the locking mechanism and the restricting mechanism can be controlled individually of each other.

Moreover, with the above-described arrangement, in e.g. a valve timing control apparatus provided for the discharge side, the internal combustion engine can be started under the condition of the relative rotational phase being restrained reliably to the most advanced angle phase so as to restrict generation of hydrocarbon ("Cold HC") at the time of engine start and even if a control operation to the angle retarding side under the cold state is effected subsequently, the relative rotational phase can be restricted to a predetermined phase between the most advanced angle phase and the most retarded angle phase.

According to the fifth characterizing feature of the valve timing control apparatus relating to the present invention, said locking member is configured to hold said restricting member therein, and said locking groove and said restricting groove are formed integral.

With the above-described arrangement in which the locking member holds the restricting member therein and the locking groove and the restricting groove are formed integral, the locking mechanism and the restricting mechanism can be formed as one compact unit. Further, in comparison with an arrangement of the locking member being in local contact with the restricting member, the above-described arrangement of the invention (the locking member is configured to hold the restricting member therein) ensures a greater contact area between these two components, so that the locking member and the restricting member can move relative to and together with each other without mechanical looseness therebetween.

According to the sixth characterizing feature of the valve timing control apparatus relating to the present invention, said restricting member includes a first shaft portion and a first flange portion provided on the retracting side in the projecting/retracting direction of the first shaft portion;

said locking member includes a second shaft portion for holding a portion of the first shaft portion on the projecting side in the projecting/retracting direction and a second flange portion provided in said second shaft portion;

said first flange portion, said second flange portion and a portion on the projecting side in the projecting/retracting direction of the second shaft portion are slidable relative to said accommodating portion;

said restriction retaining passageway is connected to a first space formed between a portion of the accommodating portion on the retracting side in the projecting/retracting direction and said first flange portion;

said lock releasing passageway is connected to a second space formed between a portion of the accommodating portion on the projecting side in the projecting/retracting direction and the second flange portion;

said restriction releasing passageway is connected to a third space formed between said accommodating portion and a projecting side leading end portion of the second shaft portion when the locking member has retracted from the locking groove; and when the restricting member is retracted from the restricting groove, said restriction retaining passageway is closed by said first flange portion.

With the above-described arrangement, the restricting member has the shape with the first flange portion provided in the first shaft portion and the locking member has the shape with the second flange portion provided in the second shaft portion, and the projecting side portion of the first shaft portion is held by the second shaft portion. Namely, the locking member is movable relative to the restricting member along the first shaft portion. The locking member and the restricting member are slidable relative to the accommodating portion via the first flange portion, the second flange portion and the projecting side portion of the second shaft portion in the projecting/retracting direction. The accommodating portion is divided into the first space on the retracting side relative to the first flange portion in the projecting/retracting direction and the second space on the projecting side relative to the second flange portion. Also, upon retraction of the locking member from the locking groove, there is formed, in the accommodating portion, the third space on the projecting side relative to the projecting side leading end portion of the second shaft portion in the projecting/retracting direction.

As the hydraulic pressure of the work fluid fed via the lock releasing passageway into the second space is applied to the second flange portion, the locking member will retract from the locking groove along the first shaft portion. Simultaneously, as the hydraulic pressure of the work fluid fed via the restriction retaining passageway into the first space is applied to the first flange portion, the restricting member will be retained under its state of being projected into the restricting groove. The locking member will retract until the second shaft portion comes into contact with the first flange portion. Hence, the locking member and the restricting member become movable together. After retraction of the locking member from the locking groove, upon feeding of the work fluid to the third space via the restriction releasing passageway, the hydraulic pressure of this work fluid will act on the projecting side leading end portion, whereby the locking member will be moved to further retracting side. The restricting member will move in unison with the locking member and retract from the restricting groove. Upon retraction of the restricting member from the restricting groove, the restriction retaining passageway is closed by the first flange portion. But, as the lock releasing passageway and the restriction releasing passageway are kept open, with feeding of the work fluid to either one of the advanced angle chamber and the retarded angle chamber, the locking member and the restricting member can be kept under the respective retracted states thereof.

As described above, with the simple configurations of providing the locking member and the restricting member with the shaft portions and the flange portions, the locking mechanism and the restricting mechanism can be freely controlled individually of each other. Also, the number of components can be small and the assembly efficiency can be improved as well. Incidentally, in the above arrangement, the projecting side portion of the second shaft portion is rendered slidable relative to the accommodating portion. Therefore, no communication is established between the second space and the third space, so that no erroneous actions of the locking member and the restricting member occur, either. And, as the locking member and the restricting member slide relative to the accommodating space through the three portions, i.e. the first flange portion, the second flange portion and, the projecting side portion of the second shaft portion in the projecting/retracting direction, there occurs no mechanical looseness at the time of movements thereof and these members can project and retract in stable manner. Further, in the above arrangement, the work fluid is caused to act on the first flange portion, the second flange portion and the projecting side leading end portion, the receiving pressures of the hydraulic pressure can be well-balanced, thus improving the reliability in the projection retention of the restricting member and the retracting movements of the locking member and the restricting member.

According to the seventh characterizing feature of the valve timing control apparatus relating to the present invention, as viewed along the projecting/retracting direction, a pressure receiving area of said restricting member receiving the work fluid from said restriction retaining passageway is set greater than a pressure receiving area of said locking member receiving the work fluid from said lock releasing passageway.

With the above-described arrangement wherein as viewed along the projecting/retracting direction, a pressure receiving area of the restricting member receiving the work fluid from the restriction retaining passageway is set greater than a pressure receiving area of the locking member receiving the work fluid from the lock releasing passageway, when the work fluid is fed to the first space and the second space, the force which pushes the restricting member toward the projecting side is greater than the force which pushes the locking member to be retracted from the locking groove. Therefore, it is possible to retain the restricting member under its state of being projected into the restricting groove in a reliable manner, without being affected by the retracting movement of the locking member from the locking groove.

According to the eighth characterizing feature of the valve timing control apparatus relating to the present invention, the apparatus further comprises:

a first urging mechanism for urging said restricting member to be projected into the restricting groove; and a second urging mechanism for urging said locking member and said restricting member away from each other along the projecting/retracting direction.

With the above arrangement, when the work fluid is discharged from the advanced angle chamber or the retarded angle chamber or when there occurs a drop in the hydraulic pressure of the work fluid acting on the locking member and the restricting member, the restricting member will be projected into the restricting groove under the urging force of the first urging mechanism. Also, as the locking member is urged away from the restricting member under the urging force of the second urging mechanism, when brought into opposition to the locking groove, the locking member will project into this locking groove and get retained therein. Therefore, regardless of the disposing orientations of the locking mechanism and the restricting mechanism, the projecting movements of the locking member and the restricting member can take place in a reliable manner.

According to the ninth characterizing feature of the valve timing control apparatus relating to the present invention, the apparatus further comprises:

a fluid control valve for controlling feeding/discharging of the work fluid to/from the advanced angle chamber and the retarded angle chamber;

wherein said locking member and said restricting member are operated in response to action of the work fluid fed from said fluid control valve.

With the above-described arrangement, only with controlling of the fluid control valve, controlling of the feeding/discharging of the work fluid to/from the advanced angle chamber and the retarded angle chamber and controlling of the movements of the locking member and the restricting member are made possible. Hence, there is no need to provide any special control mechanism for controlling the movements of the locking member and the restricting member, so that reduction of the number of components and reduction in the manufacture costs can be realized.

BRIEF DESCRIPTION OF THE DRAWINGS

[FIG. 1] is a side view in section showing the general construction of a valve timing control apparatus,

[FIG. 2] (*a*) shows a section along II-II in FIG. 1 when a locking member and a restricting member are under their projected states, (*b*) is a developed section along IIb-IIb in (*a*),

[FIG. 3] (*a*) shows a section along II-II in FIG. 1 when the locking member is retracted, (*b*) is a developed section of (*a*),

[FIG. 4] (*a*) shows a section along II-II in FIG. 1 at time of an intermediate restricted phase, (*b*) is a developed section of (*a*),

[FIG. 5] (*a*) shows a section along II-II in FIG. 1 when the restricting member is retracted, (*b*) is a developed section of (*a*),

[FIG. 6] (*a*) shows a section along II-II in FIG. 1 at time of the most retarded angle phase, (*b*) is a developed section (*a*), and

[FIG. 7] is an exploded perspective view showing constructions of a locking mechanism and a restricting mechanism.

MODES OF EMBODYING THE INVENTION

Now, with reference to FIGS. 1 through 7, a valve timing control apparatus relating to the present invention will be described by way of an embodiment wherein the apparatus is applied as an exhaust-valve side, valve timing control apparatus in an automobile engine. FIG. 2 (*b*) shows a developed section along direction IIb-IIb in FIG. 2 (*a*). Unlike IIb-IIb shown in FIG. 2, FIGS. 3 through 6 do not indicate the development direction, but the development directions of the respective figures (*b*) thereof are same as that of FIG. 2.

[General Construction]

This valve timing control apparatus 1, as shown in FIG. 1, includes a housing 2 as a "drive-side rotor" rotatable in synchronism with an unillustrated crankshaft of an engine and an inner rotor 3 disposed coaxial relative to the housing 2 and acting as a "driven-side rotor" rotatable in synchronism with a cam shaft 101. The cam shaft 101 is a rotary shaft of an unillustrated cam which controls opening/closing of an exhaust valve of the engine.

The valve timing control apparatus 1 further includes a locking mechanism 6 capable of restraining a relative rotational phase of the inner rotor 3 relative to the housing 2 and a restricting mechanism 5 capable of restricting the relative rotational phase within a predetermined range.

[Inner Rotor and Housing]

The inner rotor 3 is assembled integral to the leading end of the cam shaft 101. Meanwhile, the cam shaft 101 is rotatably assembled to an unillustrated cylinder head of the engine.

The housing 2 includes a front plate 21 provided on the opposite side to the side to which the cam shaft 101 is connected, an outer rotor 22 including a timing sprocket 22*a* as an integral part thereof, and a rear plate 23 provided on the side connected to the cam shaft 101. The outer rotor 22 is mounted externally on the inner rotor 3 and is clamped between the front plate 21 and the rear plate 23. And, the front plate 21, the inner rotor 22 and the rear plate 23 are fastened together means of bolts. As a result, the rotor 3 is rotatable relative to the housing 2 across a predetermined range.

In operation, when the crankshaft is driven to rotate, its rotational drive force is transmitted via a force transmitting member 102 to a timing sprocket 22*a*, whereby the housing 2 is driven to rotate along a relative rotational direction S shown in FIG. 2. Then, in association with this rotational drive of the housing 2, the inner rotor 3 is driven to rotate along the relative rotational direction S thereby to rotate the cam shaft 101, so that the cam mounted on this cam shaft 101 pushes down the exhaust valve of the engine to open this valve.

As shown in FIG. 2 (*a*), the outer rotor 22 forms a plurality of projecting portions 24 projecting along the radial direction and spaced along the relative rotational direction S. Each projecting portion 24 and the inner rotor 3 together define a fluid pressure chamber 4. In the instant embodiment, the fluid pressure chambers 4 are provided at four positions. However, the invention is not limited thereto.

On the outer peripheral face of the inner rotor 3 facing each fluid pressure chamber 4, there is formed a projecting portion 31 as a "partitioning portion" projecting outward along the radial direction. The projecting portion 31 divides the fluid pressure chamber 4 into an advanced angle chamber 41 and a retarded angle chamber 42 along the relative rotational direction S.

The inner rotor 3 defines advanced angle oil passageways 43, with each advanced angle oil passageway 43 being communicated with the advanced angle chamber 41 corresponding thereto. The inner rotor 3 defines also retarded angle oil passageways 44, with each retarded angle oil passageway 44 being communicated with the retarded angle chamber 42 corresponding thereto. As shown in FIG. 1, the advanced angle oil passageways 43 and the retarded angle oil passageways 44 are connected to a fluid feeding/discharging mechanism 7 which will be described later.

In operation, as work oil is supplied to or discharged from the advanced angle chamber 41 and the retarded angle chamber 42 by the fluid feeding/discharging mechanism 7, the hydraulic pressure of this work oil is applied to the projecting portion 31. With this, the relative rotational phase of the inner rotor 3 relative to the housing 2 is displaced to the angle advancing direction S1 or the angle retarding direction S2 shown in FIG. 2 (*a*) or retained at a any desired phase. This work oil corresponds to what is referred to as "work fluid" in the present invention. The angle advancing direction S1 is the direction for rotating the projecting portion 31 relative to the housing 2 to increase the volume of the advanced angle chamber 41, this direction being denoted with S1 in the figure. The angle retarding direction S2 is the direction to increase the volume of the retarded angle chamber 42, this angle being denoted with S2 in the figure.

The predetermined range over which the housing 2 and the inner rotor 3 are rotatable relative to each other, that is, the phase difference between the most advanced angle phase and the most retarded angle phase corresponds to the range across which the projecting portion 31 can be displaced inside the fluid pressure chamber 4. The most retarded angle phase is the phase where the volume of the retarded angle chamber 42 is at its maximum. The most advanced angle is the phase where the volume of the advanced angle chamber 41 is at its maximum. That is to say, the relative rotational phase can be displaced between the most advanced angle phase and the most retarded angle phase.

As shown in FIG. 1, a torsion spring 103 is provided between the inner rotor 3 and the front plate 21. And, the housing 2 and the inner rotor 3 are urged by the torsion spring 103 to displace the relative rotational phase to the angle advancing direction S1.

[Fluid Feeding/Discharging Mechanism]

The construction of the fluid feeding/discharging mechanism 7 will be briefly described. The fluid feeding/discharging mechanism 7, as shown in FIG. 1, includes a pump 71 driven by the engine to feed the work oil, a fluid control valve (OCV) 72 for controlling feeding/discharging of the work oil to/from the advanced angle oil passageways 43 and the retarded angle oil passageways 44 and an oil pan 73 for reserving an amount of the work oil.

The pump 71 is a mechanical type hydraulic pump driven when receiving the rotational drive force of the crankshaft. This pump 71 draws the work oil reserved in the oil pan 73 and discharges this work oil to the downstream side.

The fluid control valve 72 operates according to control of the amount of electric power supply by an ECU 8 (Engine Control Unit). With switching operations of the fluid control valve 72 and controlling of the pump 71, three kinds of control are made possible, namely; control of work oil supply to the advanced angle chamber 41 and work oil discharge from the retarded angle chamber 42; control of work oil discharge from the advanced angle chamber 41 and work oil supply to the retarded angle chamber 42; and control of stopping of supply/feed of work oil to/from the advanced angle chamber 41 and the retarded angle chamber 42. The control of work oil supply to the advanced angle chamber 41 and work oil discharge from the retarded angle chamber 42 is the "angle advancing control". In response to execution of this angle advancing control, the projecting portion 31 is relatively moved or rotated in the angle advancing direction S1 relative to the outer rotor 22, whereby the relative rotational phase is displaced toward the angle advancing side. The control of work oil discharge from the advanced angle chamber 41 and work oil supply to the retarded angle chamber 42 is the "angle retarding control". In response to execution of this angle retarding control, the projecting portion 31 is relatively moved or rotated in the angle retarding direction S2 relative to the outer rotor 22, whereby the relative rotational phase is displaced toward the angle retarding side. In response to execution of stopping of supply/feed of work oil to/from the advanced angle chamber 41 and the retarded angle chamber 42, the projecting portion 31 is not relatively moved or rotated, instead, the relative rotational phase can be retained at a desired phase.

In the instant embodiment, when the electric power supply is switched "ON", the fluid control valve 72 is moved to the left side in FIG. 1, to form a work oil passageway circuitry that allows the angle retarding control. When the electric power supply is switched "OFF", the fluid control valve 72 is moved to the right side in FIG. 2 to form a work oil passageway circuitry that allows the angle advancing control.

Incidentally, in this embodiment, by varying the duty ratio, the amount of electric power supply to the fluid control valve 72 is controlled to enable controlling of the amount of work oil supply to the advanced angle chamber 41 and the retarded angle chamber 42 and controlling of the amount of work oil discharged from the angle advanced chamber 41 and the angle retarded chamber 42.

Next, there will be described one after another respective components, e.g. an accommodating portion 32, the restricting mechanism 5, the locking mechanism 6, a lock releasing passageway 37, a restriction retaining passageway 36, a restriction releasing passageway 38, etc.

[Accommodating Portion]

The accommodating portion 32, as shown in FIG. 7, is a through hole defined in the projecting portion 31 as viewed along the projecting/retracting direction of the locking member 61 (simply, the "projecting/retracting direction" hereinafter). The accommodating portion 32 extends through the inner rotor 3 from the side of the front plate 21 to the side of the rear plate 23. The accommodating portion 32 has a shape of two cylindrical spaces (or cylindrical volumes) of differing diameters stacked one upon the other, including a reduced diameter portion 32*a*, an enlarged diameter portion 32*b* and a step portion 32*c*. Incidentally, the projecting/retracting direction is parallel with the rotational axis of the cam shaft 101 and the accommodating portion 32 is open perpendicularly to the front plate 21 and the rear plate 23.

[Locking Mechanism]

The locking mechanism 6, as shown also in FIG. 7, includes a locking member 61 and a locking groove 26. When the locking member 61 disposed within the accommodating portion 32 projects into/retracts from the locking groove 26 defined in the rear plate 23, restraint of the relative rotational angle and release of this restraint are made possible.

The locking member 61 includes a cylindrical second shaft portion 62 and a second flange portion 63 having a greater diameter than the second shaft portion 62. The second flange portion 63 is provided at an intermediate portion of the second shaft portion 62 with respect to the projecting/retracting direction. Advantageously, the second shaft portion 62 and the second flange portion 63 are formed integral. The second shaft portion 62 includes an inner peripheral face 62*a* as a cylindrical inner face, an outer peripheral face 62*b*, a leading end face 62*c* on the side projecting into the locking groove 26 and a contact face 62*d* on the opposite side to the leading end face 62*c*. The second flange portion 63 includes a pressure receiving face 63*a* on the side of the locking groove 26, an outer peripheral face 63*b*, and a spring receiving face 63*c* on the side of the first flange portion 53. As may be apparent also from FIG. 2 (*b*), the area of the pressure receiving face 63*a* is set greater than the area of the spring receiving face 63*c*.

The locking groove 26 is a circular groove defined in the rear plate 23 on the side of the inner rotor 3. This locking groove 26 includes a side portion 26*a* and a bottom portion 26*b*. The inner diameter of the locking groove 26 is set to be slightly greater than the outer diameter of the second shaft portion 62 so that the locking member 61 projected therein can be retained. When the locking member 61 is retained in the locking groove 26, the relative rotational movement of the inner rotor 3 is restrained, thus restraining its relative rotational phase. In the instant embodiment, the position of the locking groove 26 is set such that the relative rotational phase may be restrained to the most advanced angle phase by the locking mechanism 6.

[Restricting Mechanism]

The restricting mechanism 5, as shown in FIG. 7, includes a restricting member 51 and a restricting groove 25. In operation, as the restricting member 51 disposed within the accommodating portion 32 projects into/retracts from (moves in and out of) the restricting groove 25, restriction of the relative rotational phase within a predetermined range and releasing of this restriction are made possible.

The restricting member 51 includes a cylindrical first shaft portion 52 and a first flange portion 53 having a greater diameter than the first shaft portion 52. The first flange portion 53 is formed at one side end portion of the first shaft portion 52. Advantageously, the first shaft portion 52 and the first flange portion 53 can be formed integral. The first shaft portion 52 includes an outer peripheral face 52*a* and a leading end face 52*b* formed on the other side than the side having the first flange portion 53 and on the side for projection into the restricting groove 25. The first flange portion 53 includes a pressure receiving face 53*a* on the opposite side to the leading end face 52*b*, an outer peripheral face 53*b* and a contact face 53*c* on the side of the leading end face 52*b*. As may be apparent from the illustration in FIG. 2 (*b*), the area of the pressure receiving face 53*a* is set greater than the area of the pressure receiving face 63*a*.

For causing the locking member 61 to hold the restricting member 51 therein, the first shaft portion 52 is inserted into the hollow portion of the locking member 61. The outer diameter of the first shaft portion 52 is set to be slightly smaller than the inner diameter of the locking member 61 and the length of the first shaft portion 52 is set to be slightly greater than the length of the locking member 61. That is, the locking member 61 is slidable relative to the restricting member 51, with the inner peripheral face 62*a* sliding along the outer peripheral face 52*a* of the first shaft portion 52. Also, when the contact face 53*c* comes into contact with the contact face 62*d*, the restricting member 51 and the locking member 61 become movable in unison together.

The restricting groove 25 is an elongate groove defined in the face of the rear plate 23 on the side of the inner rotor 3 and has an arcuate shape centering about the rotary axis thereof. The restricting groove 25 includes a first end portion 25*a*, a second end portion 25*b* and a bottom portion 25*c*. It should be noted that this restricting groove 25 is formed integral with the locking groove 26. A portion of the side portion 26*a* of the locking groove 26 is used also as the first end portion 25*a*. The bottom portion 26*b* of the locking groove 26 shares the same face as the bottom portion 25*c* of the restricting groove 25 and a portion of the bottom portion 26*b* is used also as the bottom portion 25*c*. The terminal end on more angle regarding side than the first end portion 25*a* constitutes the second end portion 25*b*. And, the size of the locking groove 26 is set to allow projection of the restricting member 51 therein.

As described above, the phase where the locking member 61 becomes retained within the locking groove 26 is the most advanced angle phase. Therefore, even when the restricting member 51 projects into the restricting groove 25, there occurs no further relative rotation of the inner rotor 3 on the angle advancing side. That is, the outer peripheral face 52*a* of the firs shaft portion 52 will not come into contact with the first end portion 25*a*. On the other hand, when the restricting member 51 projects into the restricting groove 25, the outer peripheral face 52*a* comes into contact with the second end portion 25*b*, thus restricting any further displacement on the angle retarded side. That is, the relative rotational phase is restricted within the range from the most advanced angle phase to the phase corresponding to the second end portion 25*b* (this range will be referred to as the "restricted range" hereinafter). The phase corresponding to the second end portion 25*b* corresponds to what is referred to in the present invention as "a predetermined phase between the most advanced angle phase and the most retarded angle phase"), and this predetermined phase will be referred to as "an intermediate restricted phase" hereinafter.

[Assembling of Restricting Mechanism and Locking Mechanism]

The restricting mechanism 5 and the locking mechanism 6 configured as described above are assembled within the accommodating portion 32 as shown in FIG. 7 (see also FIG. 2 (*b*)). A spring 54 is interposed between the pressure receiving face 53*a* and the front plate 21 so as to urge the restricting member 51 to project into the restricting groove 25. As shown in FIG. 7, for positioning of the spring 54, a recess can be defined in the pressure receiving face 53*a*. A further spring 64 is interposed between the contact face 53*c* and the spring receiving face 63*c* so as to urge the restricting member 51 and the locking member 61 away from each other in the projecting/retracting direction. That is, the locking member 61 too is urged to project into the locking groove 26. The spring 54 corresponds to what is referred to as the "first urging means" in the context of the present invention and the further spring 64 corresponds to what is referred to as the "second urging means" in the context of the present invention.

The outer diameter of the first flange portion 53 is equal to the outer diameter of the second flange portion 63 and also slightly smaller than the inner diameter of the enlarged diameter portion 32*b* of the accommodating portion 32 and the projecting-side, outer diameter of the second shaft portion 62 is slightly smaller than the inner diameter of the reduced diameter portion 32*a* of the accommodating portion 32. Therefore, the first flange portion 53, the second flange portion 63 and the projecting-side portion of the second shaft portion 62 are slidable relative to the accommodating portion 32.

Once the restricting mechanism 5 and the locking mechanism 6 are assembled within the accommodating portion 32, as shown in FIG. 2 (*b*), the accommodating portion 32 is divided into a first space 33 on more retracting side than the first flange portion 53 in the projecting/retracting direction and a second space 34 on more projecting side than the second flange portion 63. Further, the under the urging force of the spring 64, the contact face 53*c* and the contact face 62*d* are spaced apart from each other across a clearance 39 therebetween. When no work oil is fed to the restricting mechanism 5 and the locking mechanism 6, the respective components are at rest under the condition illustrated in FIG. 2 (*b*). Even when work oil is fed, there occurs no widening of the clearance 39 from the condition illustrated in FIG. 2 (*b*). The length of the first shaft portion 52 is greater than the length of the locking member 61 by the length of the clearance 39 in the projecting/retracting direction. Hence, the relatively movable range between the restricting member 51 and the locking member 61 corresponds to the length of the clearance 39 in the projecting/retracting direction. When the locking member 61 is retracted from the locking groove 26, as shown in FIG. 3 (*b*), a third space 35 is formed in the accommodating portion 32 on more projecting side in the projecting/retracting direction than the leading end face 62*c*. Namely, the clearance 39 is set such that when the locking member 61 is retracted from the locking groove 26, the leading end face 62*c* is positioned on the retracting side relative to the inner surface 23*a*, thereby to form the third space 35. The leading end face 62*c* corresponds to what is referred to as the "projecting side leading end portion" in the present invention.

Though not shown, the accommodating portion 32, the restricting member 51 and the locking member 61 are each provided with an anti-rotation mechanism. Advantageously, this anti-rotation mechanism can comprise an irregular shape engagement consisting of a projection elongate in the projecting/retracting direction and a groove corresponding to the shape of the projection. The anti-rotation mechanism is not limited to such irregular shape engagement arrangement. However, the arrangement should not interfere with the projecting and retracting movements of the restricting member 51 and the locking member 61.

[Lock Releasing Passageway and Restriction Retaining Passageway]

As shown in FIG. 2 and FIG. 7, the projecting portion 31 defines the lock releasing passageway 37 which establishes communication between the retarded angle chamber 42 and the second space 34. This lock releasing passageway 37 is formed along the relative rotational movement direction of the inner rotor 3.

The projecting portion 31 defines a restricting retaining passageway 36 which establishes communication between the retarded angle chamber 42 and the first space 33. This restricting relating passageway 36 is defined along the relative rotational movement direction of the inner rotor 3.

When work oil is fed to the retarded angle chamber 42 from the fluid feeding/discharging mechanism 7, the work oil is fed into the second space 34 via the lock releasing passageway 37. As shown in FIG. 2, while the restricting member 51 is projecting into the restricting groove 25, simultaneously with the feeding of the work oil to the second space 34, the work oil is fed also into the first space 33 via the restricting retaining passageway 36. As the area of the pressure receiving face 53*a* is greater than the area of the pressure receiving face 63*a*, when the work oil is fed to the first space 33 and the second space 34, the hydraulic pressure of the work oil acting on the pressure receiving face 53*a* is greater than the hydraulic pressure of the work oil acting on the pressure receiving face 63*a*. Therefore, as shown in FIG. 3, the restricting member 51 is retained under its state of projecting into the restricting groove 25 and only the locking member 61 is retracted from the locking groove 26. Eventually, as the contact face 62*d* comes into contact with the contact face 53*c*, the retracting movement of the locking member 61 will be stopped. In this way, the restraint by the locking mechanism 6 is released. In this regard, it is noted that the urging force of the spring 64 is set to be smaller than the hydraulic pressure acting on the pressure receiving face 63*a* so as not to hinder the retracting movement of the locking member 61.

[Restriction Releasing Passageway]

As shown in FIG. 4 and FIG. 7, the projecting portion 31 defines a restriction releasing passageway 38 branched from the advanced angle oil passageway 43. The restriction releasing passageway 38 consists of a groove defined in a face of the projecting portion 31 and the rear plate 23. And, for allowing feeding of the work oil through the advanced angle oil passageway 43 into the third space 35 which is formed upon retraction of the locking member 61 from the locking groove 26, the restriction releasing passageway 38 is open to the reduced diameter portion 32*a* of the accommodating portion 32. As shown in FIG. 2, while the locking member 61 is projected into the locking groove 26, the restriction releasing passageway 38 is closed by the outer peripheral face 62*b*.

As shown in FIG. 4, under the intermediate restricted phase, communication is established among the third space 35, the restricting groove 25 and the locking groove 26. Therefore, as work oil is fed into the third space 35 and the third space 35, the restricting groove 25 and the locking groove 26 have been filled with the work oil, the hydraulic pressure of the work oil is applied to the leading end face 62*c*, thus urging the locking member 61 toward the retracting side. Under this condition, as the contact face 53*c* and the contact face 62*d* are in contact with each other, the restricting member 51 will be moved together with the locking member 61 to retract from the restricting groove 25. Eventually, as shown in FIG. 5 (*b*), the spring 54 will be contracted to its limit and the retracting movements of the restricting member 51 and the locking member 61 will be stopped. In this way, the restriction by the restricting mechanism 5 will be released. In this regard, it is noted that the urging force of the spring 54 and the urging force of the spring 64 are set to be smaller than the hydraulic pressure acting on the leading end face 62*c* so as not to hinder the retracting movement of the restricting member 51.

Once the restricting member 51 has been retracted from the restricting groove 25, the restriction retaining passageway 36 will be closed by the outer peripheral face 53*b* of the first flange portion 53. On the other hand, the lock releasing passageway 37 maintains the communication between the second space 34 and the retarded angle chamber 44. Also, the restriction releasing passageway 38 is kept open to the third space 35. Therefore, after the retraction of the restricting member 51 from the restricting groove 25, with feeding of the work oil to either the advanced angle chamber 41 or the retarded angle chamber 42, the locking member 61 and the restricting member 51 both will be maintained under the retracted states thereof. As a result, as shown in FIG. 6, the relative rotational phase can be freely displaced. Namely, after the release of the restriction by the restricting mechanism 5, the lock releasing passageway 37 and the restriction releasing passageway 38 function as the retraction retaining passageways for retaining the locking member 61 and the restricting member 51 under the retracted states thereof.

In this way, by the simple construction of forming the locking member 61 and the restricting member 51 respectively of a shaft portion and a flange portion, there is realized free individual control of the locking mechanism 6 and the restricting mechanism 5. Further, the number of components can be reduced and the assembly efficiency can be improved also. Incidentally, since the above arrangement provides sliding of the projecting side portion of the second shaft portion 62 relative to the reduced diameter portion 32*a* of the accommodating portion 32, no communication is established between the second space 34 and the third space 35, so that erroneous operations of the locking member 61 and the restricting member 51 will not occur.

[Leak Passageway]

As shown in FIG. 2 and FIG. 7, the outer peripheral face 63*b* of the second flange portion 63 defines a leak passageway 65. Advantageously, this leak passageway 65 can be a groove extending along the projecting/retracting direction. With provision of this leak passageway 65, even when e.g. an amount of work oil is leaked from the first space 33 or the second space 34 into the gap between the first flange portion 53 and the second flange portion 63, this work oil will be held between the first flange portion 53 and the second flange portion 63 at the time of the retraction of the locking member 61 and then discharged into the second space 34. Therefore, there occurs no interference to the retracting movement of the locking member 61.

[Operation of Valve Timing Control Apparatus]

Next, there will be described the operation of the valve timing control apparatus 1 in case the engine is started under the condition of the relative rotational phase being at the most advanced angle phase.

Under the stopped condition of the engine, the pump 71 is stopped. Also, the power supply to the fluid control valve 72 is "OFF" and there is being formed a work oil passageway or circuit allowing an angle advancing control. As shown in FIG. 2, the locking member 61 is retained within the locking groove 26 and the relative rotational phase is restrained to the most advanced angle phase by the locking mechanism 6 and the restricting member 51 too is projected into the restricting groove 25.

Upon initiation of the start-up control of the engine, a cranking will be effected. In this, the pump 71 will be activated by this cranking, but as the power supply to the fluid control valve 72 is still "OFF" and there is being formed the work oil passageway (or circuit) allowing the angle advancing control, so no work oil is fed to the first space 33 or to the second space 34, hence, the restraint by the locking mechanism 6 is maintained. Under this condition, although the work oil is fed to the restriction releasing passageway 38, as the third space 35 is not yet formed and the restriction releasing passageway 38 is still closed by the outer peripheral face 62*b* of the second shaft portion 62, the restricting member 51 is kept under the condition of projecting into the restricting groove 25.

Upon start-up of the engine by the cranking, the ECU 8 will execute the angle advancing control, whereby the work oil is fed from the fluid control mechanism 7 to the angle advanced chamber 43. However, yet, no feeding of work oil to the first space 33 and the second space 34 occurs, and the third space 35 is not yet formed, either. Therefore, the restraint by the locking mechanism 6 and the restriction by the restricting mechanism 5 will be maintained.

In this way, at the time of start-up of the engine, the relative rotational phase will be restrained to the most angle advanced phase. When the relative rotational phase is at this most angle advanced phase, the exhaust valve will be opened in the midst of the explosion stroke and will be closed in the midst of the exhaust stroke. The un-discharged portion of the exhaust gas will be compressed in the exhaust stroke. Therefore, when the intake valve is opened, the compressed exhaust gas will be fed in reverse toward the intake port side. If the engine is started under the condition of the relative rotational phase being at the most angle advanced phase, the temperature of the intake air will be raised by the presence of the exhaust gas having the high temperature, thus promoting atomization of the fuel. As a result, even at the time of cold engine start, generation of hydrocarbons at the time of engine start can be restricted advantageously.

When the exhaust side valve timing control apparatus 1 is positioned at the most advanced angle phase, the above-described effect can be obtained. However, this applies a significant load to the engine revolution. As a result, there occurs a drop in the engine output torque, which can lead to deterioration in the fuel consumption efficiency. Therefore, after lapse of a few seconds from the engine start-up, the relative rotational phase will be displaced toward the angle retarding side.

When the ECU 8 effects an angle retarding control, the work oil is fed from the fluid control mechanism 7 to the retarded angle oil passageways 44. Thus, the work oil is fed to the first space 33 and the second space 34, so that, as shown in FIG. 3, the locking member 61 is retracted from the locking groove 26, thus releasing the restraint by the locking mechanism 6. However, since the restricting member 51 is still projected into the restricting groove 25, the restriction by the restricting mechanism 5 is maintained; that is, the relative rotational phase is still restricted within the restricted range. Under this condition, although the third space 35 is formed, no work oil is fed to this third space 35, because of the angle retarding control.

Thereafter, the relative rotational phase will begin to be displaced in the angle retarding direction S2. However, as shown in FIG. 4, since the outer peripheral face 52*a* of the first shaft portion 52 comes into contact with the second shaft portion 25*b* of the restricting groove 25, the restricting member 51 cannot be displaced toward the angle retarding side beyond the intermediate restricted phase. At this time, due to the urging force toward the angle retarding side by the angle retarding control, the restricting member 51 will be fixed in position as being pressed against the second end portion 25*b*. That is, the relative rotational phase is restricted to the intermediate restricted phase.

The intermediate restricted phase is not particularly limited, but can be any desired phase between the most advanced angle phase and the most retarded angle phase. When an engine is started in a cold district, the work oil is still at a low temperature after lapse of a few seconds, so that the oil has high viscosity and poor fluidity. Therefore, it is difficult to maintain the relative rotational phase to a desired phase by means of the hydraulic pressure of the work oil. Hence, in such a situation like this, in order to displace the relative rotational phase to the angle retarding side, it is needed for the fluid feeding/discharging mechanism 7 to increase the feeding pressure of the work oil. For this reason, there is the possibility of the relative rotational phase reaching the most retarded angle phase. In this case, the exhaust valve has been opened to a middle position in the intake stroke. In this situation, if the intake side valve timing control apparatus employs the Atkinson cycle at the time of idling after engine startup, the above situation will invite inadvertent occurrence of an air intake operation from the exhaust valve side in the course of the intake stroke, whereby the advantageous effect obtained from the use of the Atkinson cycle cannot be obtained. On the other hand, with the inventive arrangement described above, the relative rotational phase can be restricted to the intermediate restricted phase, so that the advantageous effect of using the Atkinson cycle can be obtained appropriately.

Thereafter, in order to displace the relative rotational phase as desired, the ECU 8 will effect the angle advancing control, so that the work oil is fed through the restriction releasing passageway 38 to the third space 35. Therefore, as shown in FIG. 5, the restricting member 51 will be retracted from the restricting groove 25, thus releasing the restriction by the restricting mechanism 5. As a result, as shown in FIG. 6, it becomes possible to displace the relative rotational phase from the intermediate restricted phase further in the angle retarding direction S2.

During a normal operation of the engine, the work oil is fed to either one of the angle advanced chamber 41 or the angle retarded chamber 42. Accordingly, after realization of the released state, the restricting member 51 and the locking member 61 will be maintained under the retracted states, respectively. Therefore, thereafter, the relative rotational phase can be set to any appropriate phase according to the rotational speed and the load of the engine, within the range from the most advanced angle phase to the most retarded angle phase.

When the engine is stopped and the work oil is discharged from the second space 34 and the third space 35, due to the urging force of the torsion spring 103, the relative rotational phase will be displaced to the most advanced angle phase. Therefore, the restricting member 51 and the locking member 61 will project into the restricting groove 25 and the locking groove 26, respectively. Hence, it is possible to set the relative rotational phase to the most advanced angle phase, in preparation for the next engine startup. It should be noted, however, that the means for displacing the relative rotational phase to the most advance phase at the time of engine stop is not limited to the urging force of the above-described torsion spring 64.

The inventive valve timing control apparatus can be used as an intake side valve timing control apparatus.

The shapes of the restricting member, the locking member and the accommodating portion are not limited to those disclosed in the foregoing embodiment. Unless these are formed cylindrical or round column like shapes, the anti-rotation mechanism described will not be needed. However, the cylindrical or round-column like shapes are more advantageous since they allow smooth projecting/retracting movements of the restricting member and the locking member.

INDUSTRIAL APPLICABILITY

The present invention can be applied to a valve timing control apparatus capable of reliably restraining or restricting the relative rotational phase to a predetermined phase between the most advanced angle phase and the most retarded angle phase at the time of stop or startup of an internal combustion engine and effecting opening/closing timing controls of an exhaust valve and an intake valve of the engine of an automobile or the like.

DESCRIPTION OF REFERENCE MARKS

1 valve timing control apparatus
2 housing (drive-side rotor)
3 inner rotor (driven-side rotor)
4 fluid pressure chamber
5 restricting mechanism
6 locking mechanism
25 restricting groove
26 locking groove
31 projecting portion (partitioning portion)
32 accommodating portion
33 first space
34 second space
35 third space
36 restricting retaining passageway
37 lock releasing passageway
38 restriction releasing passageway
41 advanced angle chamber
42 retarded angle chamber
51 restricting member
52 first shaft portion
53 first flange portion
54 spring (first urging mechanism)
61 locking member
62 second shaft portion
62*c* leading end face (projecting side leading end portion)
63 second flange portion
64 spring (second urging mechanism)
101 cam shaft

The invention claimed is:

1. A valve timing control apparatus comprising:

a drive-side rotor rotatable in synchronism with a crankshaft of an internal combustion engine;

a driven-side rotor disposed coaxially relative to the drive-side rotor and rotatable in synchronism with a valve opening/closing cam shaft of the internal combustion engine;

a fluid pressure chamber formed by said drive-side rotor and said drive-side rotor;

a partitioning portion provided in at least one of said drive-side rotor and said driven-side rotor for partitioning said fluid pressure chamber into an advanced angle chamber and a retarded angle chamber;

a locking mechanism including;

a locking member disposed within an accommodating portion formed in one of said drive-side rotor and said driven-side rotor and projectable to and retractable from the other rotor than the one rotor having said accommodating portion; and a locking groove defined in said other rotor for receiving and retaining said locking member projected therein;

said locking mechanism restraining a relative rotational phase of said driven-side rotor relative to said drive-side rotor when said locking member is retained within said locking groove; and a restricting mechanism including;

a restricting member disposed within said accommodating portion and projectable to and retractable from said other rotor so as to be movable relative to and together with said locking member in a projecting/retracting direction of said locking member, and a restricting groove defined in the form of an elongate slot in said other rotor so as to receive said restricting member projected therein, said restricting mechanism restricting said relative rotational phase within a predetermined range when said restricting member projects into said restricting groove.

2. The valve timing control apparatus according to claim 1, wherein said locking mechanism is configured to restrain the relative rotational phase to the most advanced angle phase, the most retarded angle phase or a predetermined phase between the most advanced angle phase and the most retarded angle phase, and said restricting mechanism is configured to restrict the relative rotational phase within a range from either the most advanced angle phase or the most retarded angle phase to said predetermined phase.

3. The valve timing control apparatus according to claim 1, further comprising:

a lock releasing passageway capable of applying work fluid to said locking member to retract this locking member from said locking groove;

a restriction retaining passageway capable of applying the work fluid to said restricting member only when said restricting member has projected into said restricting groove for retaining this restricting member projected into said restricting groove; and a restriction releasing passageway capable of applying the work fluid at least to said locking member of the locking member and the restricting member only when said locking member has retracted from said locking groove for retracting the restricting member from the retracting groove via the locking member.

4. The valve timing control apparatus according to claim 3, wherein:

said lock releasing passageway is formed in the rotor having said accommodating portion for establishing constant communication between either said advanced angle chamber or said retarded angle chamber and said accommodating portion;

said restriction retaining passageway is formed in said rotor having said accommodating portion and capable of establishing communication between said accommodating portion and the same one chamber of the advanced angle chamber and the retarded angle chamber as said chamber communicated by said lock releasing passageway;

said restriction releasing passageway is formed in either said drive-side rotor or said driven-side rotor and capable of establishing communication between said accommodating portion and the other chamber of said advanced angle chamber and said retarded angle chamber than the one chamber communicated by said lock releasing passageway; and neither said lock releasing passageway nor said restriction retaining passageway are communicated with said restriction releasing passageway via said accommodating portion.

5. The valve timing control apparatus according to claim 3, wherein said locking member is configured to hold said restricting member therein, and said locking groove and said restricting groove are formed integral.

6. The valve timing control apparatus according to claim 5, wherein:

said restricting member includes a first shaft portion and a first flange portion provided on the retracting side in the projecting/retracting direction of the first shaft portion;

said locking member includes a second shaft portion for holding a portion of the first shaft portion on the projecting side in the projecting/retracting direction and a second flange portion provided in said second shaft portion;

said first flange portion, said second flange portion and a portion on the projecting side in the projecting/retracting direction of the second shaft portion are slidable relative to said accommodating portion;

said restriction retaining passageway is connected to a first space formed between a portion of the accommodating portion on the retracting side in the projecting/retracting direction and said first flange portion;

said lock releasing passageway is connected to a second space formed between a portion of the accommodating portion on the projecting side in the projecting/retracting direction and the second flange portion;

said restriction releasing passageway is connected to a third space formed between said accommodating portion and a projecting side leading end portion of the second shaft portion when the locking member has retracted from the locking groove; and when the restricting member is retracted from the restricting groove, said restriction retaining passageway is closed by said first flange portion.

7. The valve timing control apparatus according to claim 6, wherein as viewed along the projecting/retracting direction, a pressure receiving area of said restricting member receiving the work fluid from said restriction retaining passageway is set greater than a pressure receiving area of said locking member receiving the work fluid from said lock releasing passageway.

8. The valve timing control apparatus according to claim 6, further comprising:

a first urging mechanism for urging said restricting member to be projected into the restricting groove; and a second urging mechanism for urging said locking member and said restricting member away from each other along the projecting/retracting direction.

9. The valve timing control apparatus according to claim 1, wherein further comprising:

a fluid control valve for controlling feeding/discharging of the work fluid to/from the advanced angle chamber and the retarded angle chamber;

wherein said locking member and said restricting member are operated in response to action of the work fluid fed from said fluid control valve.

* * * * *